US006227421B1

(12) United States Patent
Richard et al.

(10) Patent No.: US 6,227,421 B1
(45) Date of Patent: May 8, 2001

(54) TUNDISH EQUIPPED WITH A TUBE CHANGER AND PLATE FOR THE TUBE CHANGER

(75) Inventors: Francois-Noël Richard, Nancy (FR); Hubert Abels, Ponneroeul (BE)

(73) Assignee: Vesuvius Crucible Company, Wilmington, DE (US)

( * ) Notice: Subject to any disclaimer, the term of this patent is extended or adjusted under 35 U.S.C. 154(b) by 0 days.

(21) Appl. No.: 09/125,774

(22) PCT Filed: Feb. 12, 1997

(86) PCT No.: PCT/EP97/00634

§ 371 Date: Dec. 4, 1998

§ 102(e) Date: Dec. 4, 1998

(87) PCT Pub. No.: WO97/30807

PCT Pub. Date: Aug. 28, 1997

(30) Foreign Application Priority Data

Feb. 22, 1996 (FR) ..... 96 02656

(51) Int. Cl.[7] ..... B22D 41/08

(52) U.S. Cl. ..... 222/607; 22/590; 22/591; 22/606

(58) Field of Search ..... 266/236, 44; 222/590, 222/591, 606, 607

(56) References Cited

U.S. PATENT DOCUMENTS 3,907,022 9/1975 Schloemann et al. .
4,669,528 6/1987 Szadkowski .
5,984,153 * 11/1999 Richard ..... 222/590

FOREIGN PATENT DOCUMENTS 0 442 515 8/1991 (EP) .
2 064 123 7/1971 (FR) .
95 03906 2/1995 (WO) .
96/34713 11/1996 (WO) .

* cited by examiner

*Primary Examiner*—Scott Kastler
(74) *Attorney, Agent, or Firm*—James R. Williams

(57) ABSTRACT

The invention concerns a tundish for continuous casting in a steel mill, equipped with at least one tube changer (18). The changer has a frame (20) mounted under the tundish (2), at least one fixed plate (8) and a tube (28), having a plate (30) at its upper part, means (36) for applying the plate (30) of the tube (28) against the fixed plate (8), their surface in contact forming a junction plane (34). The junction plane (34) is inclined at a nonzero angle α with respect to the horizontal. The new tube (28) passes from the introduction position to the casting position and the worm tube from the casting position to the evacuation position by a sliding movement on the junction plane (34), following a trajectory at least partially nonrectilinear, the combination of the angle of inclination α of the junction plane, dimensions of the tubes (30) and the trajectories of these latter being such that the tubes (30) avoid the casting mold (42) during a tube change.

14 Claims, 7 Drawing Sheets

14
8
10
16
20
8
50
54
48
46
52
10
32b
28b
32
28
42

TUNDISH EQUIPPED WITH A TUBE CHANGER AND PLATE FOR THE TUBE CHANGER

The present invention concerns a continuous casting tundish for a steel mill, equipped with at least one tube changer, this changer being comprised of a chassis mounted on the tundish, refractory pieces that delimit a pouring channel for passage of the steel from the tundish to a continuous casting mold, those refractory pieces being comprised of at least one fixed plate and a tube having a plate at its upper end, means for exerting pressure for applying the plate of the tube against the fixed plate, their surfaces forming a junction plane, a position for introducing a new tube, a casting position and a position for evacuating a worn tube, guidance means that permit the new tube to pass from the introduction position to the casting position and the worn tube to pass from the casting position to the evacuation position, actuating means for passing the new tube from the introduction position to the casting position and the worn tube from the casting position to the evacuation position.

An example of such a device is described in the French patent application registered under N° 95 05 504. This device presents advantages over the other existing devices, as described for example in the document EP 0 192 019. However, it has the shortcoming of requiring cylindrical sliding surfaces for the fixed plate and for the tube plate. To guarantee a good tightness of the plates, it is necessary that the radii of the fixed plates and the tube plate be absolutely identical, which involves difficulties in machining. Furthermore, these plates are subject to thermal stresses during casting and it is not certain that the deformations caused by their thermal expansion are identical over the entire periphery of the plates, which can cause a lack of tightness between these plates. It is also known that the pouring channel in such a device is generally under a lower pressure than atmospheric pressure. To avoid any aspiration of air that would cause a chemical perturbation and degradation of the steel quality. at least one groove that runs completely around the pouring channel is generally provided in one of the fixed of mobile plates, this groove being supplied with a neutral gas under pressure, such as argon for example, such that any aspiration is that of neutral gas that does not cause a chemical degradation of the steel. The machining of such grooves on cylindrical plates proves extremely difficult and costly.

The present invention concerns a tundish equipped with a tube changer that has the same advantages as the device described above but not the disadvantages.

According to the principal characteristic of the invention, the junction plane is inclined at a nonzero angle ($\alpha$) relative to the horizontal; the new tube passes from the introduction position to the casting position and the worn tube from the casting position to the evacuation position by a sliding movement on the junction plane following a trajectory at least partially not rectilinear, the combination of the angle of inclination ($\alpha$) of the junction plane, the dimensions and the trajectories of the tubes being such that the tubes avoid the casting mold during a tube change.

The combination of an inclined junction plane and a nonlinear movement makes it possible to predetermine within a broad range the original and the final positions of the tubes, an advantage the importance of which will be understood better in the following descriptions.

According to a preferred characteristic of the invention, the plates of the tubes have a front support face and a rear support face, the front and rear faces being defiled with respect to the direction of tube change, the front support face of the new tube plate coming in contact with the rear support face of the worn tube plate to push it toward the evacuation position and replace it in the casting position.

According to another preferred characteristic of the invention, the continuous casting mold has a larger dimension and a horizontal straight line of the junction plane is parallel to this larger dimension of the mold. This offers the maximum displacement possible of the tube inside of the mold.

According to another preferred embodiment, the tube change is effected along a circular sliding movement of center O in the junction plane. A rotation in effect offers the advantage of being extremely easy to effect mechanically.

According to a particular embodiment of the invention, the center O of the circular movement is higher than the level where the pouring channel passes through the junction plane. This configuration makes it possible to introduce a new tube outside of the mold and to introduce it by rotation to the inside of the mold while the tube in service situated inside the mold is removed from the mold during the exchange rotation. This configuration is adapted more particularly to molds for slabs, the shape of which is elongated, and which permit movements of the tube longitudinally inside of the mold.

According to another particular implementation form of the invention, the center O of the circular movement is lower than the level where the pouring channel passes through the junction plane. This configuration is particularly adapted for bloom molds, the section of which is square or nearly square. In such molds the changing of an immersed tube without raising the tundish implies that a new tube could be prepositioned alongside the tube in service. Considering the narrowness of the mold, this implies that the new tube is inclined so that its end is in the immediate vicinity of the end of the tube in service at the center of the mold.

According to another particular embodiment, the junction plane between the fixed plate and the tube plate is vertical. The vertical plane is preferably parallel to the major axis of the mold. This configuration, which guarantees tube movements perfectly aligned with the major axis of the mold is particularly adapted for molds for thin slabs.

According to another particular embodiment, the tube changer is located on the side on the tundish instead of being placed under the tundish as is generally done. This configuration permits suppressing a bend in the pouring channel. It also makes a free space available above the tube changer for the mechanical operations. In the continuous casting of steel, a device for regulating the flow of steel, e.g., a stopper rod or a slide valve, is generally used. The present invention offers new possibilities for combining the tube and the slide valve closure device. In particular, according to one embodiment. the tundish is equipped with a slide gate between it and the tube changer.

According to another particular embodiment, the plates of the tubes have rectilinear support faces, these support faces being inscribed in a sector of center O and with an angle to the center equal to the angle of rotation of the plates during a tube change. This configuration permits two tube plates to be pushed during the exchange without ever allowing any play between their support face when the sliding movement on the junction plane is a rotation.

When the sliding movement is not entirely a rotation, the tube plates preferably have support faces in the form of concave and convex arcs of a circle, the front support face of a plate being adapted to the rear support face that precedes it, the support faces remaining in contact over a sufficient distance to completely cover the pouring orifice at least when the support faces traverse the orifice of the fixed plate during the tube change. This configuration permits two plates/tubes to be pushed during the exchange while permanently closing off the pouring orifice.

In a tube changing system the pouring channel is normally perpendicular to the junction plane between the fixed plate and the mobile plate. When this junction plane is vertical or close to vertical, it implies that the pouring channel has the form of a bayonet between the upper container and the entrance into the fixed plate. This bayonet form of the pouring channel can present disadvantages. On the one hand, the wear of the pouring channel can be increased at the level of the bends. On the other, the bends can favor deposits, e.g., of alumina and cause a clogging of the pouring channel.

To reduce these shortcomings, a particular embodiment of the invention provides for the pouring channel to cut the junction plane at an inclined angle in order to reduce the bayonet effect.

In effect, by inclining the angle with which the pouring channel intersects the junction plane between the fixed plate and the mobile plate it is possible to bring the axis of the pouring channel closer to the vertical and thus reduce the bayonet effect.

According to a particular implementation mode, the pouring channel intersects the junction plane along an inclination angle complementary to the angle of inclination a of the junction plane relative to the horizontal so that the pouring channel is rectilinear over its entire length.

On the other hand, the invention concerns a fixed plate for a tube changer equipping a tundish according to the present invention, as well as a plate/tube assembly for a tube changer according to the present invention.

The invention is also concerned with a tube adapted to equip a tube changer. It comprises a tube and a plate having a junction plane adapted to be applied against a fixed plate of the tube changer. The junction plane is inclined at a nonzero angle ($\alpha$) with respect to the horizontal when the tube is in casting position.

Other features and advantages of the present invention will become evident from a reading of the following description of implementation examples given by means of illustration with reference to the attached Figures.

BRIEF DESCRIPTION OF THE DRAWINGS

In FIG. 1 a tundish designated by the general reference 2 is comprised of a thick bottom wall of steel 4 covered with a layer of refractory material 6. A piece of refractory material 8, called the fixed plate in the present application, perpendicularly traverses the bottom wall 4 and the layer of refractory material 6. The fixed plate 8 delimits a pouring channel 10 in its central part. Its upper part 12 forms a seat for a stopper rod 14 that makes it possible to regulate the flow of the molten steel contained in the tundish 2 through the pouring channel 10. A bottom plate 16 is fixed under the bottom of the tundish. A tube changer designated in its entirety by the general reference 18 is mounted under the bottom plate 16.

Figure 1:
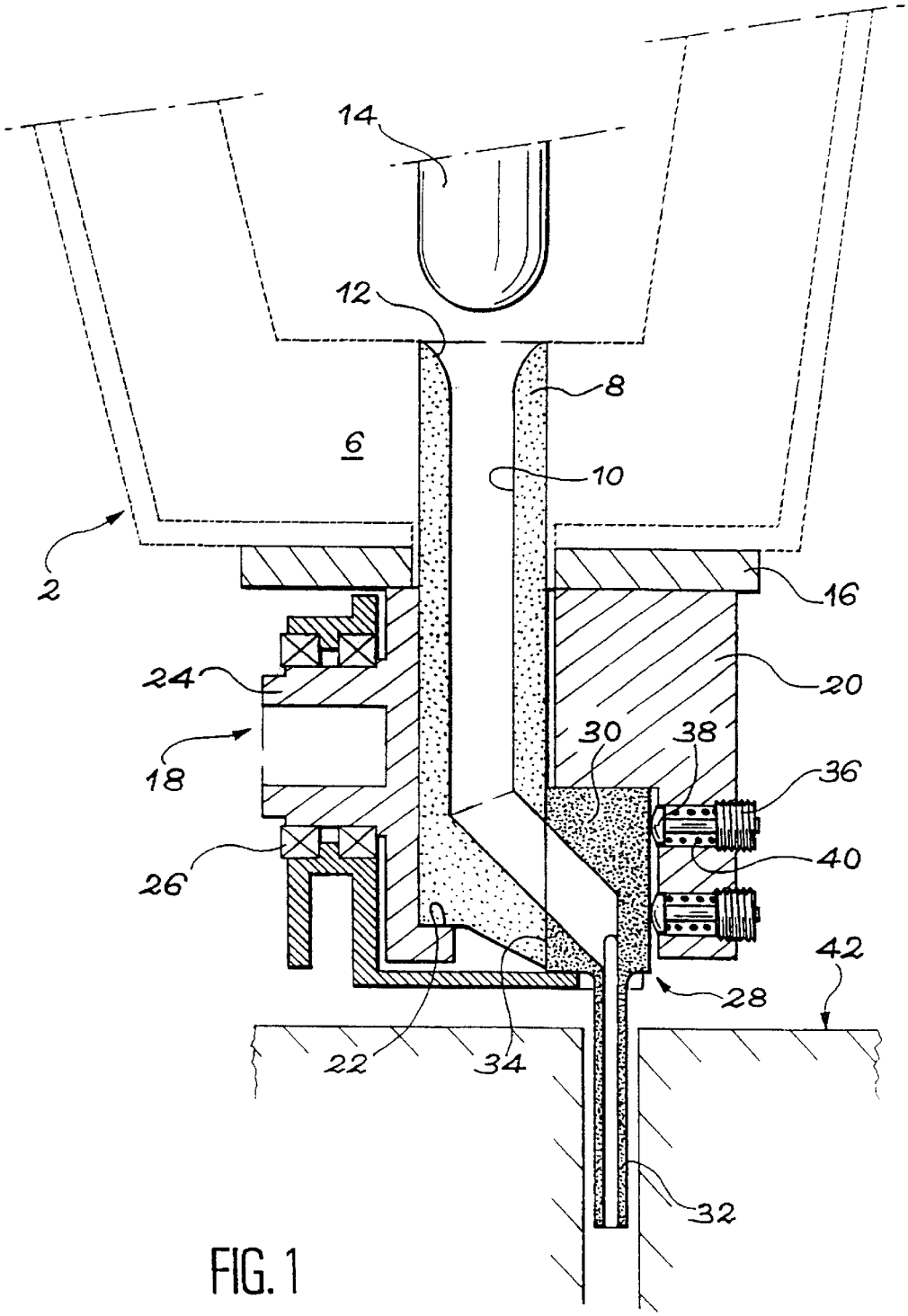
FIG. 1 is a cross sectional view of a preferred embodiment of the invention.

The changer 18 is comprised of a chassis 20 mounted in a fixed position under the bottom plate 16. The chassis receives the fixed plate 8. For this effect, this plate has a plane surface 22 by which it rests on the chassis. A rotor 24 is mounted rotating on the chassis 20 by means of bearings 26. The rotor 24 supports a plate/tube assembly 28 comprised of a plate 30 and of a tube 32. The fixed plate 8 and the plate 30 of the plate/tube assembly 28 each have a working face. These working faces are in contact with each other and define a junction plane 34. The plate 30 is applied against the fixed plate by means for applying pressure 36. In the implementation example shown. these means for applying pressure are comprised of six components with a spherical head 38 applied on the plate 30 by the springs 40. The pouring channel 10 runs through the plate/tube assembly to bring the molten steel from the tundish 2 into a casting mold 42 into which the tube 32 dips.

Figure 2:
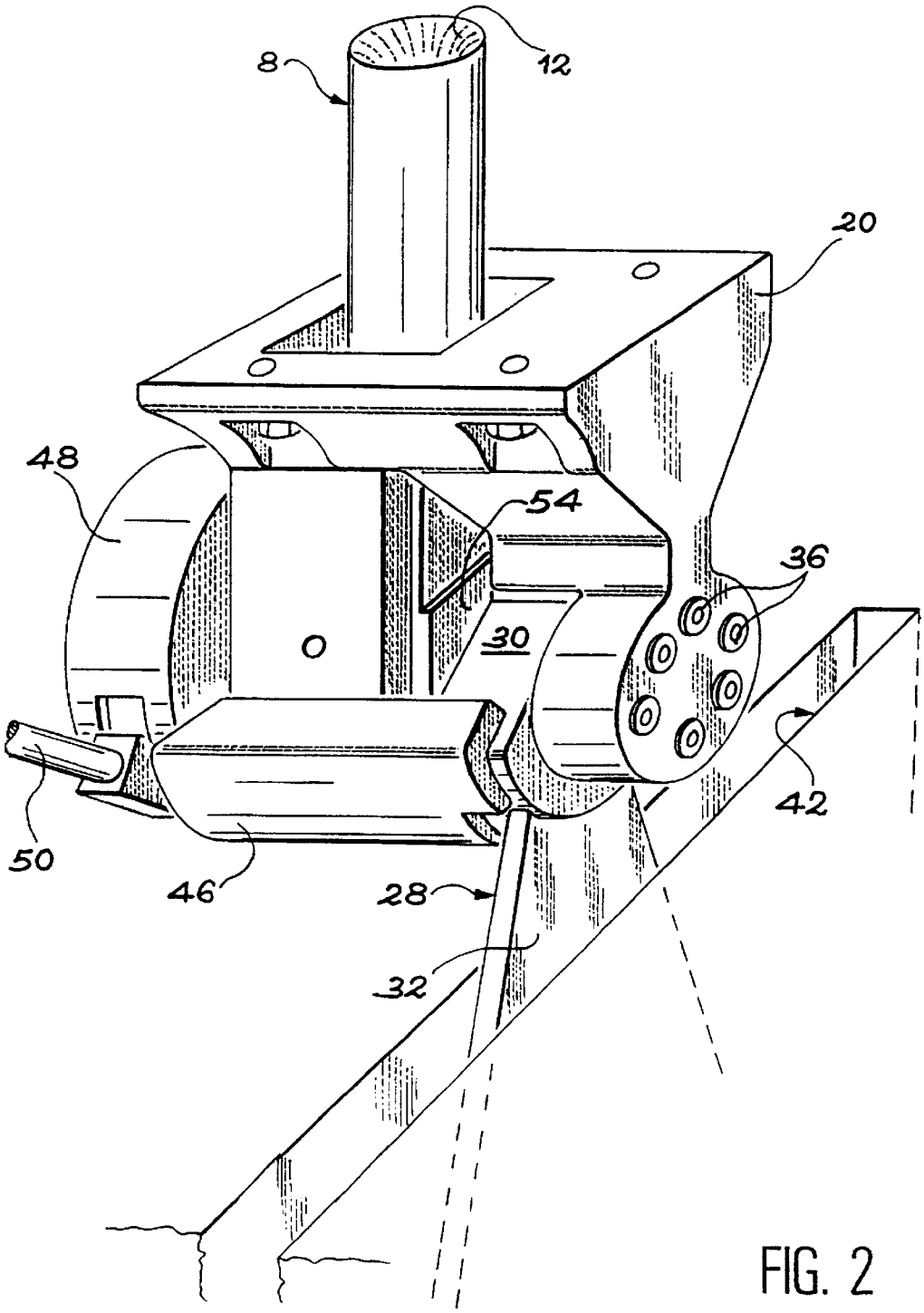
FIG. 2 is a perspective view of the tube changing device shown in FIG. 1.

FIG. 2 is a perspective view of the tube changer shown in FIG. 1. The tundish 2 and the bottom plate 16 are not shown.

It can be seen that the plate 30 essentially has the form of a sector of approximately 90° of angle to the center. In the implementation example shown the tube 32 has a quite elongated section because it is designed for a casting mold for thin slab 42 of very narrow section.

Figure 3:
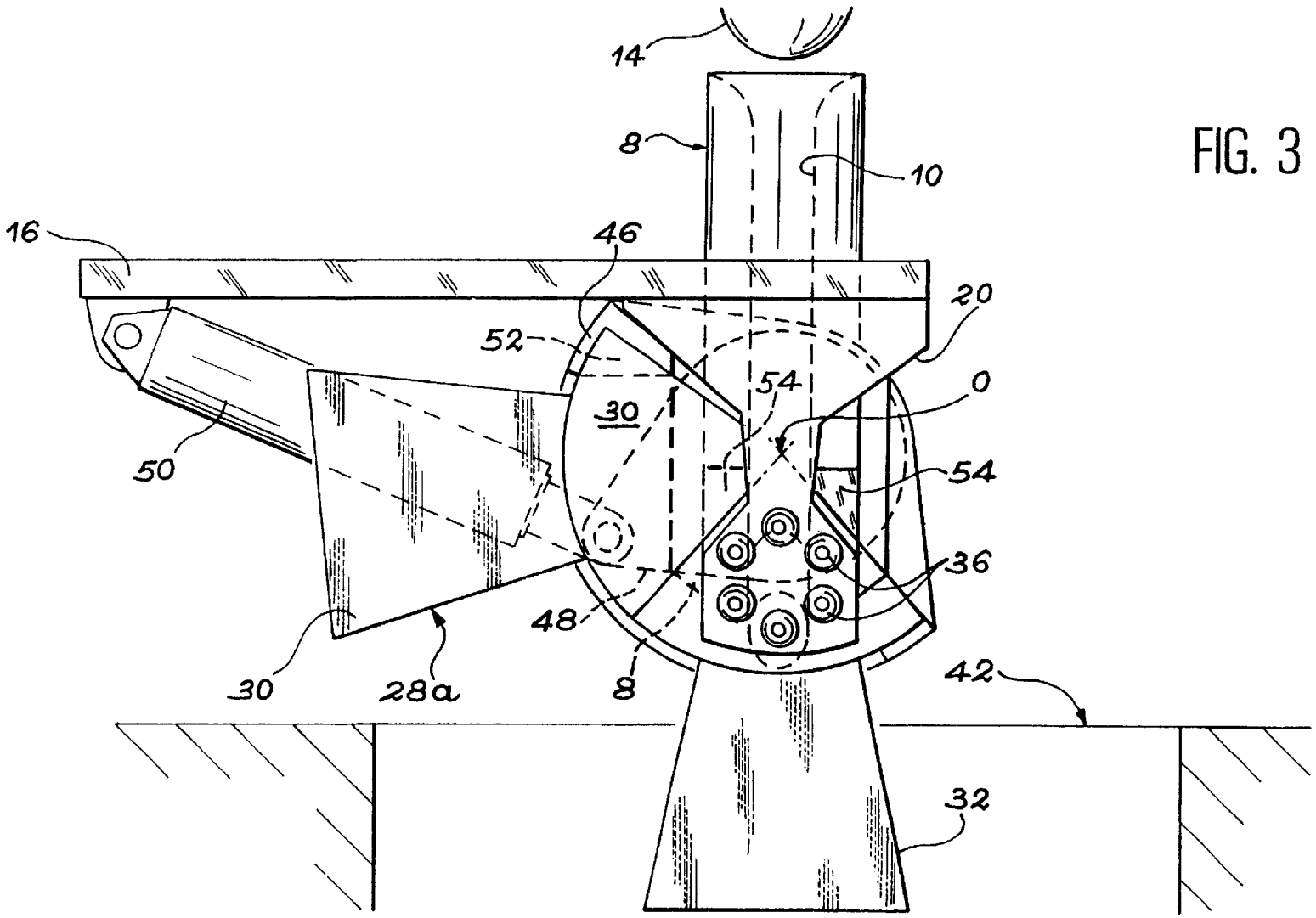
FIGS. 3 and 4 are front views of the tube changing device shown in FIGS. 1 and 2.
Figure 4:
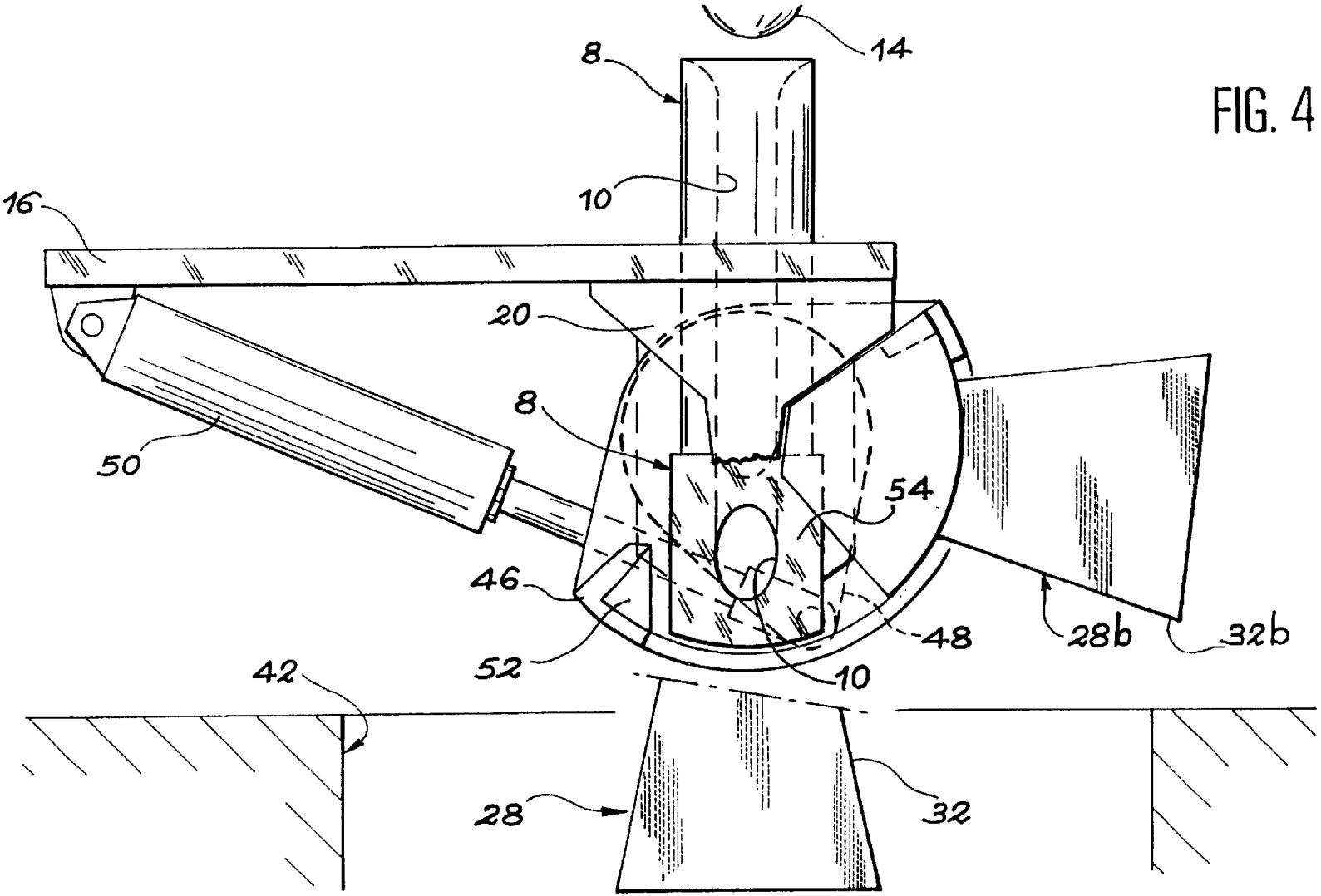

FIG. 2 also shows the actualization of the actuating means that permits passing a new tube from an introduction position (see FIG. 3) to the casting position shown in FIGS. 1 and 2, and the worn tube from the casting position to the evacuation position (see FIG. 4). These actuating means are comprised of a pusher 46 having a cross section in the form of an angle iron that is fitted on an angle of the plate 30. The pusher 46 is solid and an arm 48 is mounted on the rotor 24. The arm 48 is entrained by means of a jack 50. The jack cylinder 50 is mounted on the bottom plate 16 while its rod is fixed to the articulated arm 48.

The guidance means that permit the new tube to pass from the introduction position to the casting position and the worn tube to pass from the casting position to the evacuation position are comprised on the one hand of the working face that comprises the junction plane of the fixed plate 8 and on an other hand of the spherical heads 38 of the means for applying pressure 36. Due to these means the working face of the plate 30 effects a sliding movement on the surface of the junction plane while remaining permanently applied against this surface with a sufficient application force to produce a tightness to the molten steel.

FIGS. 3 and 4 are front views of the tube changer shown in FIGS. 1 and 2. FIG. 3 shows a new plate/tube assembly 28*a* in the introduction position (on the left in the Figure). It is introduced into the rotor along a direction perpendicular to the junction plane. The pusher 46 is equipped with a prepositioning surface 52 on which the plate 30 of the assembly 28*a* is supported. On the other hand the working face of the fixed plate 8, which is a front view on FIGS. 3 and 4, is not entirely covered by the plate 30 of the plate/tube assembly in the casting position. Two zones designated by 54 are not covered. The zone 54 situated on the left-hand part of the working face of the fixed plate 8 (according to the representation of FIG. 3) constitutes a guidance surface that permits a perfect alignment of the working face of the plate 30 of the new tube with the junction plane. The zone 54 situated on the right-hand side of the working face of the fixed plate permits guiding the worn tube during its evacuation.

FIG. 4 is identical to FIG. 3 with the exception that the new tube was placed in the working position, and the worn tube in the evacuation position 28*b*. To pass from the position shown in FIG. 3 to the position shown in FIG. 4, the arm 48 was pivoted by an angle equal to the angle of tube change, in other words, equal to the angle formed by the sector in which the plate 30 is inscribed. When the new tube passes from the introduction position to the casting position, it stays clear of the edge of the mold 28. The same is true when it passes from the casting position to the evacuation position.

According to the principal feature of the invention, the junction plane 34 is inclined at a nonzero angle $\alpha$ with respect to the horizontal. In the actualization example shown in FIGS. 1–4 the angle $\alpha$ is equal to 90°. In other words, the junction plane 34 is vertical. On the other hand, the new tube passes from the introduction position to the casting position and the worn tube from the casting position to the evacuation position by a sliding movement on the junction plane, following a trajectory at least partially nonrectilinear. In the actualization examples of FIGS. 1–4, this trajectory is circular with center O. The point O is the center of rotation around which the rotor 24 turns. This is also the point where the extensions of the support faces of the plates 30 intersect. This actualization variant presents the advantage of being particularly simple to realize mechanically. It is applicable in particular to thin slab casting because it permits precisely guiding the tube in the mold. It also permits the introduction of the new tube into the rotor outside of the steel and to withdraw the worn tube entirely outside of the steel. In this actualization the junction plane 34 is parallel to the large dimension of the mold.

Figure 9:
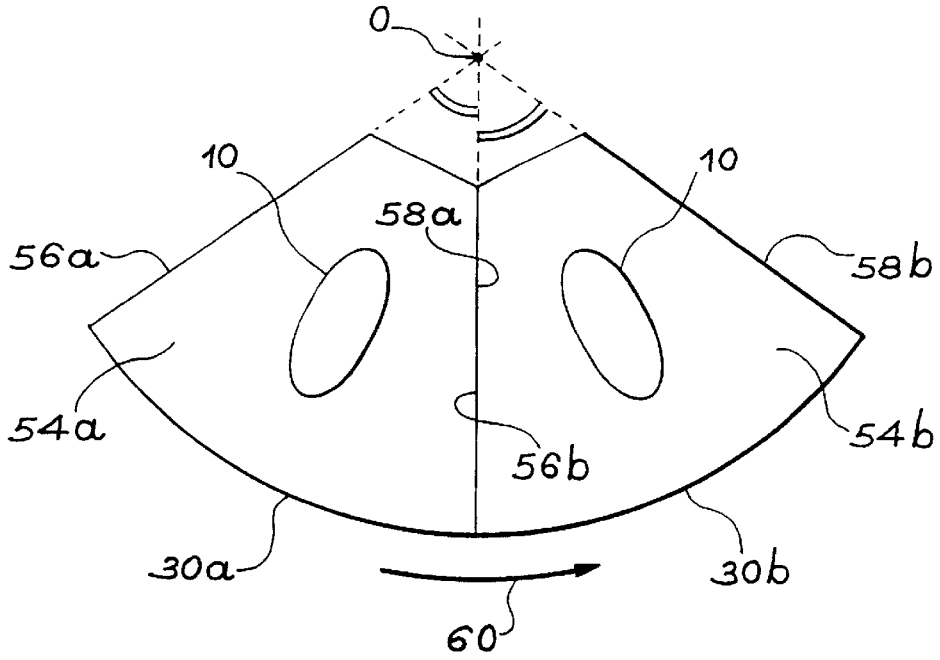
FIG. 9 is a view showing the shape of the plates where the circular movement is a rotation of center O.

FIG. 9 shows the working faces 54*a* and 54*b* of two plates 30*a* and 30*b* (for the sake of simplification, the tubes are not shown in this Figure). Each of the plates 30*a* and 30*b* respectively has a rear support face 56*a*, 56*b* and a front support face, 58*a* and 58*b*. The front 58 and rear 56 support faces are defined with regard to the direction 60 of plate change. It is evident that the front support face 58*a* of the plate 30*a* is in contact with the rear support face 56*b* of the plate 30*b*. These faces are entirely contiguous. They are applied against each other without leaving a gap for the passage of molten metal during a plate change. The support faces 56 and 58 intersect at the center O of the circular movement of plate change. The elongated and elliptical form of the section of the pouring channel 10 at the level where it intersects the junction plane 34 is also noted on FIG. 9. This elongated form is the result of the inclined angle (essentially 45° in the example of FIGS. 1–4) at which the pouring channel intersects the junction plane. It is also noted that the center O of the circular movement is higher than the level where the pouring channel 10 traverses the junction plane.

Figure 5:
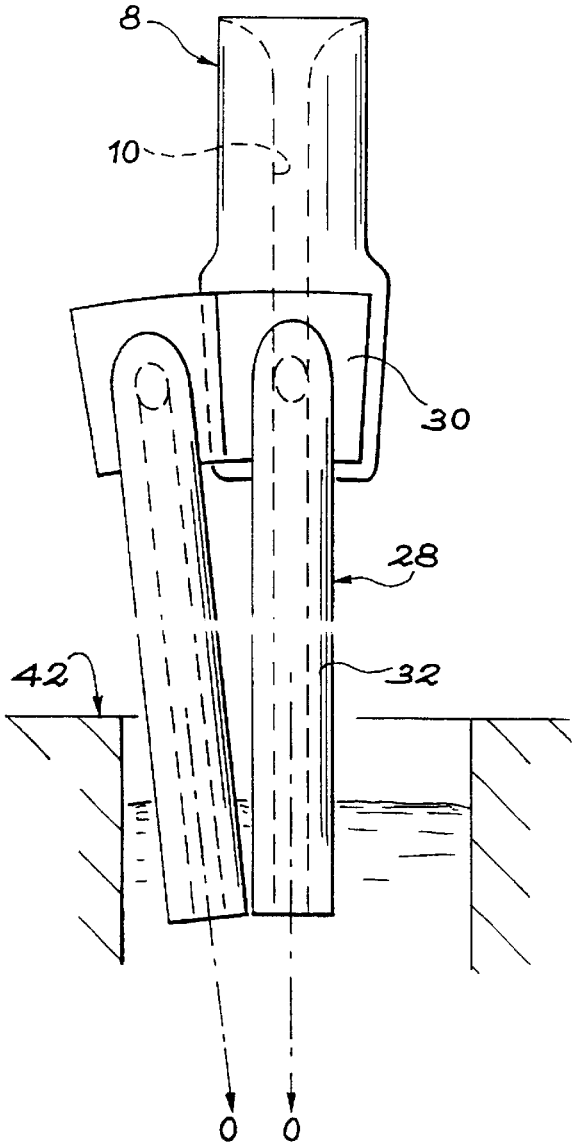
FIGS. 5 and 6 are respectively a front view and a side view of another implementation mode of the invention, in which the center of rotation is lower than the level where the pouring channel traverses the junction plane.
Figure 6:
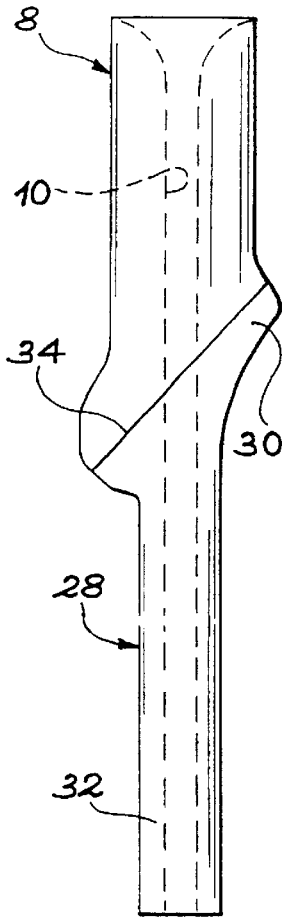
Figure 6A:
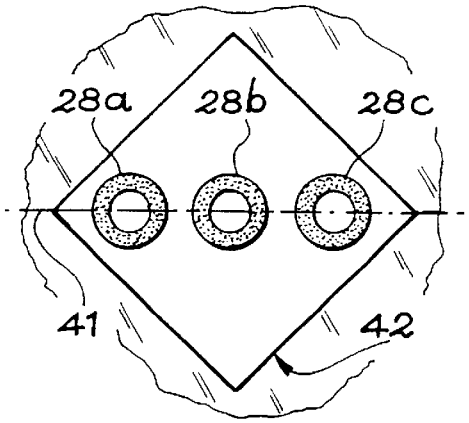
FIG. 6*a* is a top view of a mold for blooms.

FIGS. 5 and 6 show another implementation of the present invention. The junction plane 34 is inclined relative to the horizontal at an angle $\alpha$ essentially equal to 45°. This angle is the complementary of the angle with which the pouring channel 10 intersects the junction plane. In this manner, the pouring channel is rectilinear over its entire length. Contrary to the implementation mode of FIGS. 1–4 the center of rotation O is lower than the level where the pouring channel passes through the junction plane 34. Since the angle of plate change is very small, the point O is not shown in FIG. 5. This implementation mode is particularly applicable to a mold of square cross section (mold for blooms) as shown in FIG. 6*a*. A horizontal straight line of the junction plane 34 is parallel to the large dimension of the mold 41 which is comprised here of its diagonal. In this manner, a new tube 28*a* and a tube in the casting position 28*b* can be located at the same time in the mold. A tube change can then be carried out without raising the distributor by bringing the new tube 28*a* into the casting position and the tube 28*b* into the evacuation position 28*c*.

Figure 7:
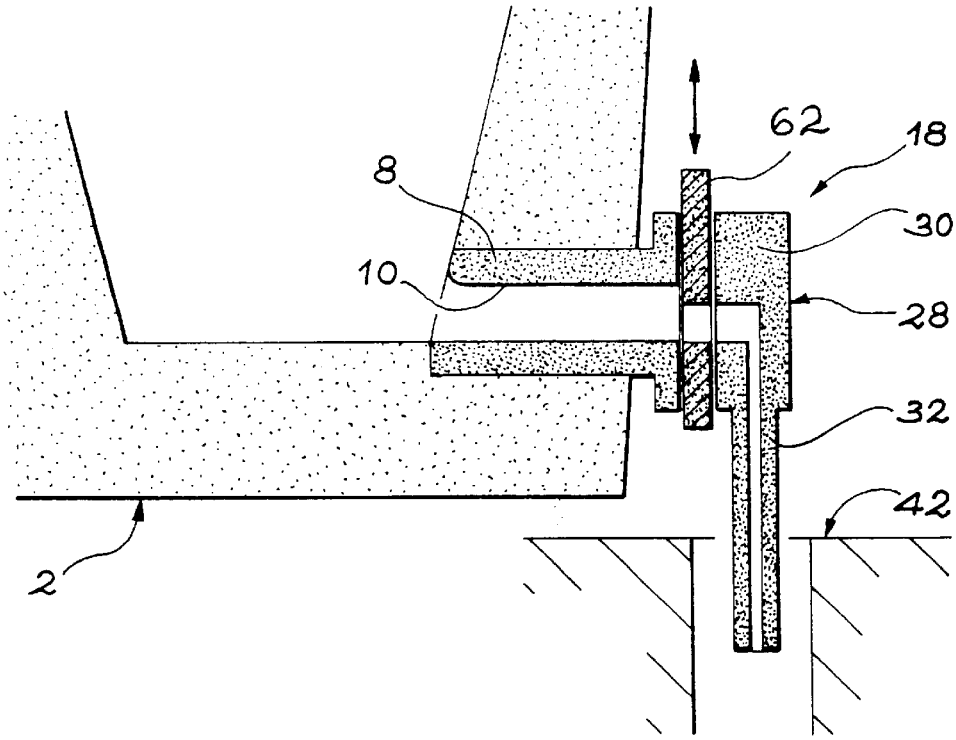
FIGS. 7 and 8 illustrate two implementation modes of the invention in which the tube changer is located on the side of the tundish.

FIG. 7 shows an implementation variant in which the tube changer 18 is located on the side of the distributor 2 instead of being under it, as is generally the case. This arrangement permits suppressing a bend in the pouring channel 10. It also offers more space for the mechanism of the tube changer. Finally, a sliding plate 62 can be interposed between the working surface of the fixed plate 8 and the working surface of the fixed plate 30 of the plate/tube assembly 28. The sliding plate 62 regulates the flow of the molten metal without having to use a stopper rod as is generally done.

Figure 8:
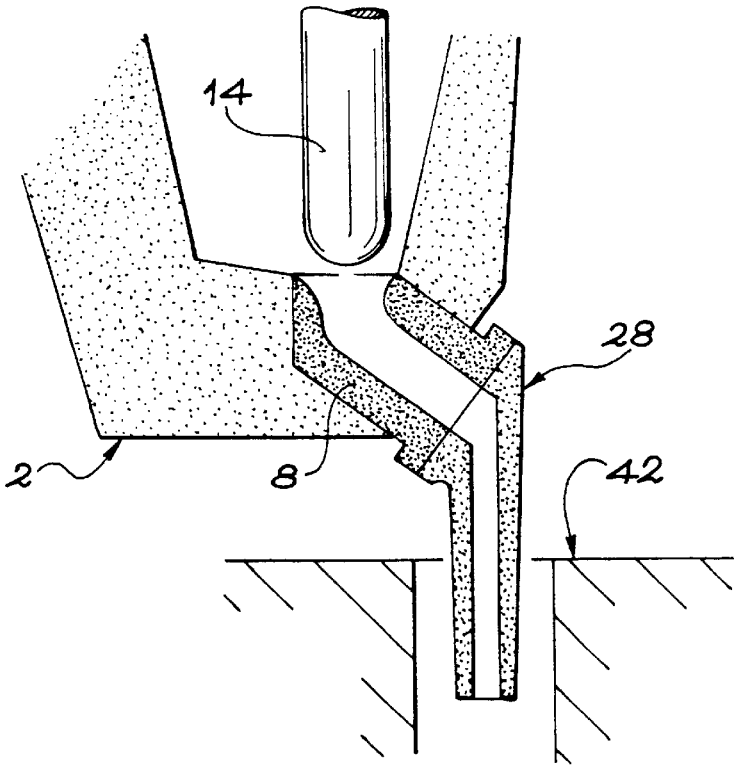

Another implementation mode of the invention is shown in FIG. 8. The tube changer is also located on the side of the distributor. The pouring channel 10 is inclined relative to the horizontal, which makes it possible to reduce the angle of the bend formed by the pouring channel in the plate/tube assembly 28. A stopper rod 14 is used in this embodiment to regulate the flow of molten metal in the mold 42.

Figure 10:
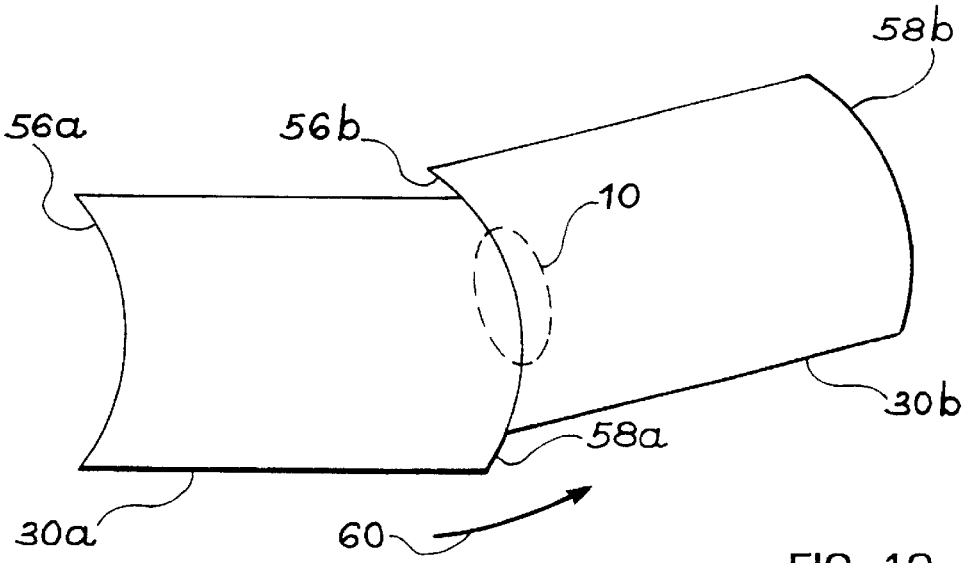
FIG. 10 is a view in the Junction plane showing the shape of the plates when the movement is different than a pure rotation.

As FIG. 9, FIG. 10 shows the working faces of two plates 30*a* and 30*b*, viewed in the junction plane 34. The plates 30*a* and 30*b* have support faces in the form of a circle arc. The rear support faces 56*a* and 56*b* have the forms of a concave circle arc. The front support faces are 58*a* and 58*b*. The front support face 58*a* of the plate 30*a* fits on the rear support face 56*b* of the plate 30*b*. Their profiles are completely contiguous without a gap, such that the molten metal cannot pass through during a plate change. The plates 30*a* and 30*b* are thus articulated with each other and one can be displaced relative to the other in order to follow any profile given by the adapted guides. This profile can include rectilinear parts, circular parts or curves of any shape. The front support face 58*a* of the plate 30*a* remains in contact over a sufficient distance with the rear support face 56*b* of the plate 30*b* to cover the pouring orifice 10 completely at least when the support faces 58*a* and 56*b* pass through the pouring orifice 10 during a tube change.

What is claimed is:

1. Tube changer comprising a frame (20) adapted to be mounted under a tundish (2), and refractory pieces (8, 28) that delimit a pouring channel (10) for the passage of steel from the tundish (2) to a continuous casting mold (42), the casting mold (42) having a horizontal top surface, these refractory pieces being comprised of at least one fixed plate (8) and a tube (28) having a tube plate (30), means (36) for applying the tube plate (30) against the fixed plate (8), whereby a junction plane (34)is defined, the frame (20) having an introduction position for a new tube, a casting position and an evacuation position for a worn tube, guidance means (34, 38) that permit the new tube to pass from the introduction position to the casting position, and the worn tube to pass from the casting position to the evacuation position, actuating means (46, 50) for passing the new tube from the introduction position to the casting position and the worn tube from the casting position to the evacuation position, characterized in that:

the junction plane (34) is inclined at a nonzero angle a with respect to the horizontal top surface of the continuous casting mold (42); and the new tube (28) passes from the introduction position to the casting position and the worn tube from the casting position to the evacuation position by a sliding movement on the junction plane (34) by following a trajectory that is at least partially nonrectilinear, and a combination of the angle $\alpha$, tube dimensions and the trajectories of the new tube and the worn tube being such that the tubes (28) avoid the casting mold (42) during a tube change.

2. Tube changer according to claim 1, for casting steel in a continuous casting mold (42) that has a larger dimension characterized in that the junction plane (34) includes a straight line parallel to the larger dimension of the mold.

3. Tube changer according to claim 1, characterized in that the new tube passes from the introduction position to the casting position, and the worn tube passes from the casting position to the evacuation position by following a circular sliding movement around a center (O) in the junction plane (34).

4. Tube changer according to claim 3, characterized in that the center (O) of the circular movement is outside of the junction plane (34).

5. Tube changer according to claim 3, characterized in that the center (O) of the circular movement is within the junction plane (34).

6. Tube changer according to claim 1, characterized in that the junction plane is perpendicular to the horizontal top surface of the casting mold (42).

7. Tube changer according to claim 1, characterized in that the tube changer is adapted to be mounted on the tundish (2).

8. Tube changer according to claim 7, characterized in that the tube changer has a sliding plate (62) located between the tundish (2) and the tube changer (18).

9. The tube changer according to claim 1, characterized in that the tube plate has two support faces, a front support face having an arc (58*a*, 58*b*) and a rear support face having a complimentary (56*a*, 56*b*) arc, whereby the front support face (58*a*, 58*b*) of the new tube plate is adapted to the rear support face (56*a*, 56*b*) of the worn tube plate that precedes the new tube plate, the support faces remaining in contact over a sufficient distance to cover the pouring orifice (10) completely when the support faces traverse the pouring orifice of the fixed plate (8) during a tube change.

10. Tube changer according to claim 1, characterized in that the pouring channel (10) intersects the junction plane (34) at an inclined angle.

11. Tube changer according to claim 10, characterized in that the pouring channel (10) intersects the junction plane (34) at an angle of $\pi/2$-$\alpha$ relative to the horizontal top surface of the casting mold (42).

12. Tube plate assembly for use in a tube changer for the continuous casting of steel into a mold, the assembly comprising a tube (28) having a tube plate (30) adapted to be applied against a fixed plate (8) of said tube changer whereby a junction plane (34) is formed, the assembly characterized in that the tube changer permits a new tube to move from an introduction position to a casting position, and a worn tube to move from the casting position to an evacuation position by following a circular sliding movement around a center (O) in the junction plane (34) the junction plane (34) being inclined at a nonzero angle ($\alpha$) with respect to the horizontal, the plate (30) having front support face (58*a*, 58*b*) and a rear support face (56*a*, 56*b*), the front and rear support faces being inscribed in a sector of center (O) and of an angle to the center equal to an angle of rotation of the plates (30*a*, 30*b*).

13. Tube plate assembly for use in a tube changer for the continuous casting of steel into a continuous casting mold (42), the casting mold (42) having a horizontal top surface, the assembly comprising a tube (28) and a tube plate (30) adapted to be applied against a fixed plate (8) of said tube changer whereby a junction plane (34) is formed, characterized in that the junction plane (34) is inclined at a nonzero angle with respect to the horizontal top surface of the mold (42) when the tube is in casting position and in that the tube plate (30) has a front support face and a rear support face in the form of arcs, the front support face (58*a*, 58*b*) of a new plate being adapted to the rear support face (56*a*, 56*b*) of the preceding worn plate.

14. Fixed plate for use in a tube changer, comprising a plate having a pouring channel (10) for the passage of steel from a tundish to a continuous casting mold (42) and a junction plane (34) for applying a tube plate (30), the casting mold (42) having a horizontal surface, characterized in that the junction plane (34) is perpendicular the horizonatal top surface of the mold when the plate is mounted in casting position in the tube changer.

* * * * *